United States Patent [19]

Hansen

[11] Patent Number: 4,955,210

[45] Date of Patent: Sep. 11, 1990

[54] CAPILLARY TUBE ASSEMBLY AND METHOD OF MANUFACTURE

[75] Inventor: William G. Hansen, Clarksville, Tenn.

[73] Assignee: American Standard Inc., New York. N.Y.

[21] Appl. No.: 398,811

[22] Filed: Aug. 25, 1989

[51] Int. Cl.[5] ..... F25B 41/06

[52] U.S. Cl. ..... 62/511; 62/525

[58] Field of Search ..... 62/511, 527, 525

[56] References Cited

U.S. PATENT DOCUMENTS

| | | | |
|---|---|---|---|
| 2,148,414 | 2/1939 | Wolfert et al. | 62/511 X |
| 2,220,595 | 11/1940 | Andersen | 62/126 |
| 2,353,240 | 7/1944 | Huggins | 62/511 X |
| 2,956,421 | 10/1960 | Stevens | 62/511 |
| 3,030,782 | 4/1962 | Karmazin | 62/515 |
| 3,864,938 | 2/1975 | Hayes, Jr. | 62/511 X |
| 4,306,421 | 12/1981 | Gucwa, Jr. et al. | 62/324.1 |

FOREIGN PATENT DOCUMENTS

| | | | |
|---|---|---|---|
| 1189567 | 3/1965 | Fed. Rep. of Germany | 62/511 |
| 910070 | 11/1962 | United Kingdom | 62/511 |

*Primary Examiner*—William E. Tapolcai

*Attorney, Agent, or Firm*—William J. Beres; David L. Polsley; William O'Driscoll

[57] ABSTRACT

A capillary tube assembly having a capillary tube body for connection to a refrigeration system and a tube end cap for accepting a plurality of capillary tubes each of which is identically preformed. The capillary tube assembly is adaptable to different refrigeration systems of varying capacity by utilizing a suitable number of identically preformed capillary tubes together with a suitable tube end cap. The capillary tube assembly is manufactured by preforming identically a suitable number of capillary tubes, preparing a tube end cap with the desired number of apertures and inserting therethrough the capillary tubes, securing the tube end cap to a capillary tube body and reducing the diameter of the tube body to the diameter of the refrigerant supply line of the refrigeration system to which the capillary tube assembly is to be applied.

10 Claims, 3 Drawing Sheets

FIG. 3
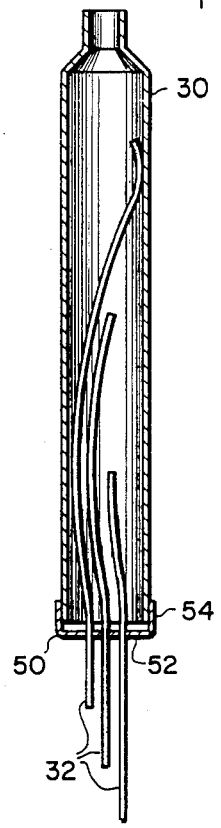
FIG. 2
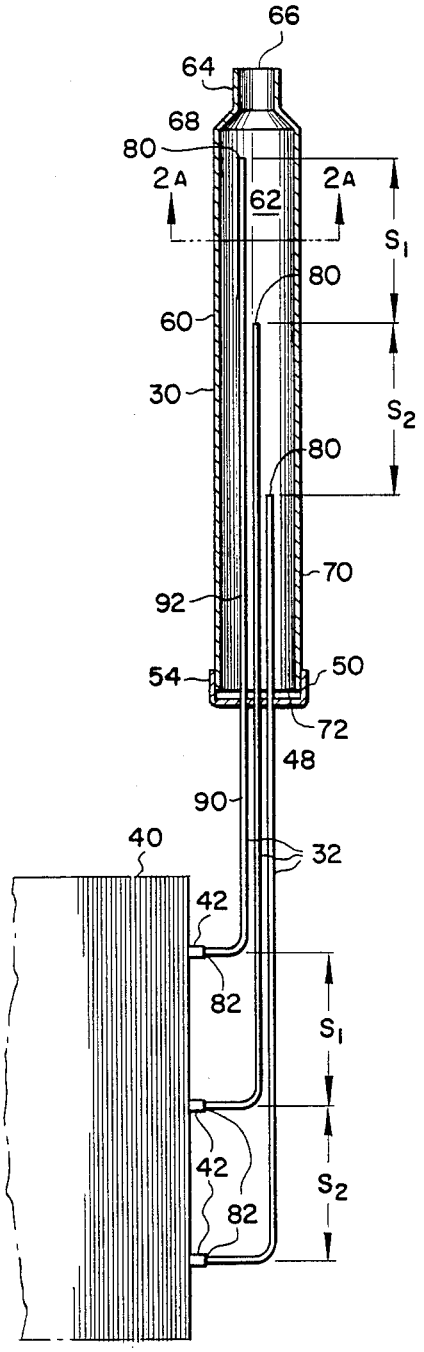
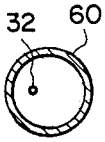
FIG. 2A
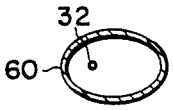
FIG. 2B
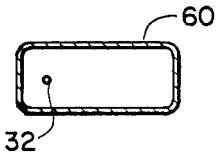
FIG. 2c

CAPILLARY TUBE ASSEMBLY AND METHOD OF MANUFACTURE

TECHNICAL FIELD

This invention pertains generally to refrigeration systems and particularly to capillary tube assemblies for expanding refrigerant in refrigerant systems.

BACKGROUND ART

Refrigerations systems, as is well known, typically are closed cycle systems having a compressor for compressing refrigerant, a condenser for rejecting heat from the system and condensing refrigerant, a means of expanding the refrigerant and an evaporator for evaporating refrigerant by accepting heat into the system from the space to be cooled. Many refrigeration systems utilize one or more capillary tubes, as the means of expanding the refrigerant. In systems where more than one tube is used, it is typical to find a strainer, which serves as an adapter to connect the capillary tubes to the liquid line from the evaporator. Each strainer is typically designed for a specific fluid flow rate and corresponding number of capillary tubes. The capillary tubes then connect to the strainer body and to the various inlet connections of the evaporator to permit refrigerant flow therebetween. The capillary tubes are of the same length so that the refrigerant flowing through each tube is suitably expanded as it reaches the evaporator.

Because the evaporator inlet connections are generally spaced apart from each other, each capillary tube must be specifically routed. This routing of capillary tubes is complicated by the fact that each tube is metal. Each tube must be provided with bends of no less than a minimum radius dictated by the type and thickness of the metal used, and the bends must be provided at points dictated by the availability of bails to secure the tubes to minimize vibration and metal fatiguing of the tubes. Furthermore, such capillary tube assemblies often require a great deal of space for the location of the tubing, requiring in turn relatively large and unwielding refrigeration systems. These capillary tube assemblies are also relatively susceptible to damage, as the capillary tubes are relatively fragile and are generally exposed at the many tube bend locations.

With the design of capillary tube assemblies bounded by these constraints, it is apparent that each capillary tube assembly must be prepared for each different refrigeration system. This is both expensive and time consuming, as a different assembly jib or fixture is typically required for each capillary tube assembly, and much time is consumed in the design and preparation of these assembly fixtures and in changing from one to another fixture during manufacture of the capillary tube assemblies as well as in the design and preparation of the capillary tube assemblies.

Therefore, it is an object of the invention to provide a capillary tube assembly suitable for use on a variety of refrigeration systems of various capacities.

It is another object of the invention to provide such a capillary tube assembly as will be easy and inexpensive to adapt to such various refrigeration systems.

It is a further object of the invention to provide such a capillary tube assembly as will be easy and inexpensive to assemble.

It is yet a further object of the invention to provide a method of assembly such a capillary tube assembly which will be substantially easy and inexpensive to implement.

It is yet a further object of the invention to provide such a method of assembling a capillary tube assembly as will minimize the time and expense of designing, preparing and changing assembly fixturing.

It is a further object of the invention to minimize the space required by the capillary tube assembly in a refrigeration system.

It is a further object of the invention to provide such a capillary tube assembly as will have a minimum possibility of damage.

SUMMARY OF THE INVENTION

The subject invention is a capillary tube assembly for refrigeration systems and a method of manufacture for the same. The capillary tube assembly is adaptable to different refrigeration systems of varying capacity by utilizing a suitable number of identically preformed capillary tubes together with a suitable tube end cap. The tube end cap is secured to a cylindrical capillary tube body having a depth for accepting a portion of the length of the capillary tubes. In order to compensate for varying distances from the tube end cap to the evaporator inlet connections, the various capillary tubes are inserted into the tube end cap and hence the capillary tube body so that only the desired length is exposed. In order to accommodate various refrigeration system plans, it may be necessary to bend the capillary tubes. However, this may be performed upon the completed assembly so that only one bending operation need be performed. Because only the minimum desired length of capillary tube is exposed, the possibility of damage is minimized and the requirements for securing the tubes is avoidable in many cases. Also, minimizing the number of bends in the capillary tubing minimizes the possibility of failure due to metal fatigue and improves noise control by minimizing vibration due to fluid flow through the tube bends.

The capillary tube assembly is manufactured by preforming substantially identically a suitable number of capillary tubes, preparing a tube end cap with the desired number of apertures and inserting therethrough the capillary tubes. A wave form bend may be performed upon the portion of the capillary tubes which will be internal to the capillary tube body to provide additional vibration and noise control. The tube end cap is then secured to the capillary tube body and the diameter of the tube body opposite that having the tube end cap is reduced to the diameter of the refrigerant supply line of the refrigeration system to which the capillary tube assembly is to be applied. The tube end cap must be sealed to both the capillary tubes and to the capillary tube body to prevent leakage.

BRIEF DESCRIPTION OF THE DRAWINGS

FIG. 2 shows a cutaway view of the capillary tube assembly of the subject invention in connection with an evaporator.

FIG. 2A shows a cutaway view of the capillary tube assembly of FIG. 1 along line 2A—2A.

FIG. 2B shows a cutaway view of an alternative embodiment of the capillary tube assembly of FIG. 1 along line 2A—2A.

FIG. 2C shows a cutaway view of a second alternative embodiment of the capillary tube assembly of FIG. 1 along line 2A—2A.

FIG. 3 shows a cutaway view of an alternative embodiment of the subject invention having a waveform bend upon the capillary tubes therefrom.

FIG. 7 shows a cross-sectional view of the capillary tube assembly of FIG. 1 along line 7—7.

DESCRIPTION OF THE PREFERRED EMBODIMENT

Figure 1:
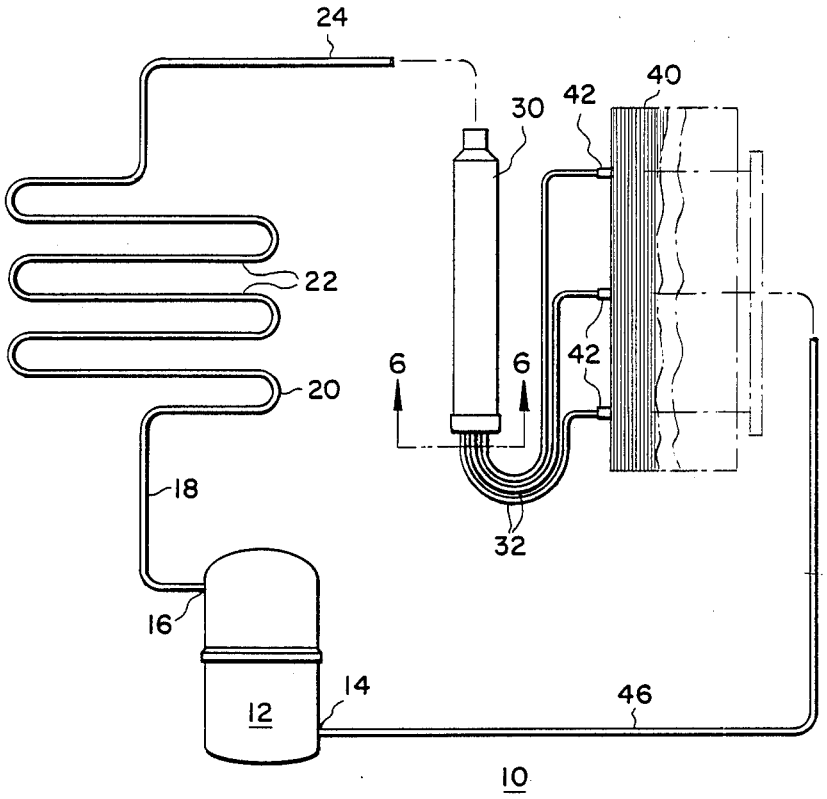
FIG. 1 shows a refrigeration system including the subject invention.

A refrigeration system, generally referred to by reference numeral 10, including the preferred embodiment of the present invention is shown in FIG. 1. Generally, the refrigeration system 10 includes a compressor 12 having a suction port 14 and a discharge port 16. A length of pipe 18 provides a flow connection between the discharge port 16 and a condenser 20 which includes a coil 22 for rejecting heat from the refrigeration system 10. Another length of pipe 24 provides a flow connection between the condenser 20 and a capillary tube assembly 30. The capillary tube assembly 30 includes a plurality of capillary tubes 32 in flow connection with an evaporator 40 via a like number of evaporator inlets 42. The refrigeration circuit of the refrigeration system 10 is completed by piping 46 which provides a flow connection from the evaporator 40 to the suction port 14 of the compressor 12. It will be appreciated that this refrigeration system 10 is a representative system, presented in simplified form for purposes of discussion, and that the capillary tube assembly 30 may be suitably employed on refrigeration systems having multiple compressors 12, multiple condensers 20, hot gas defrost systems, and many other variations.

As shown more clearly in FIG. 2, the capillary tube assembly 30 includes a plurality of substantially identically formed capillary tubes 32. These capillary tubes 32 extend through apertures 48 in a tube end cap 50. The capillary tubes 32 may be secured in the apertures 48 by such means as brazing, soldering, or welding.

In the drawing figures, three capillary tubes 32 are shown in the capillary tube assembly. It will be appreciated by those skilled in the art that a suitable capillary tube assembly 30 may have as few as one capillary tube 32, and that the number of capillary tubes 32 and apertures 48 in the tube end cap 50 will be an equal number. Furthermore, the number of capillary tubes 32 and the number of evaporator inlets 42 will also be equal and will be determined by the capacity of the refrigeration system 10. Those skilled in the art will also recognize that it would also be possible to provide refrigerant flow to a number of evaporators 40 by providing a header in pipe 24 for flow to a number of capillary tube assemblies 30 and evaporators 40, in which case the number of capillary tubes 32 in each capillary tube assembly 30 must equal the number of evaporator inlets 42 in each respective evaporator 40.

Preferably, the tube end cap 50 includes an end surface 52 and an upstanding exterior wall 54. The end surface 52 is shown as circular and in the preferred embodiment is planar for ease of manufacture. The end surface 52 would be equally suitable if formed in a convex or concave curviform. The exterior wall 54 is annular, extending from the exterior edge of the end surface 52. It will be appreciated that the exterior wall 54 must conform to the outline of the exterior edge of the end surface 52.

The tube end cap 50 is disposed upon a tube assembly body 60 which is preferably cylindrical or tubular in form, as shown in FIG. 2A. The assembly body 60 defines an interior space 62 through which refrigerant may flow from an inlet portion 64 having an aperture defining an inlet 66 to an outlet portion 70 having an aperture defining an outlet 72. Optionally, the assembly body 60 may have a cross section of ellipsoidal form, as shown in FIG. 2B, or a cross section of rectangular form as shown in FIG. 2C. The inlet portion 64 generally will be of a diameter less than the size of the outlet portion 70, so that the pipe 24 may be joined and sealed thereto to provide a leakproof flow of refrigerant into the tube assembly body 60. One or more strainers or filters 68 may be installed, as by press fit or soldering in a bracket (not shown), in the interior 62 as desired to filter particulate matter from refrigerant flowing therethrough.

FIG. 7 shows another view of the capillary tube assembly shown in FIG. 1 taken along line 7—7.

Such variations in the form of the tube assembly body 60 do not affect the operation of the subject invention. However, the tube end cap 50 must be formed according to the form of the outlet portion 70 of the tube assembly body 60, since the exterior wall 54 must be sealed and secured thereto. This could be accomplished by such means as welding, soldering or brazing the exterior wall 54 to the outlet portion 70, as required to meet applicable codes and standards known to those skilled in the arts. In FIG. 2, the exterior wall 54 is shown in close fit about the exterior of the outlet portion 70, but it will be appreciated that this is done for ease of manufacture only, and that it would be equally suitable to size the exterior wall 54 for a close fit in insertion into the interior 62 of the tube assembly body 60.

Each capillary tube 32 is preformed identically for ease of manufacture. As shown in FIG. 2, each tube 32 includes a capillary tube inlet 80 and a capillary tube outlet 82, providing a flow path through the tube 32. Adjacent the capillary tube outlet 82 is a bend, shown as a 90 degree bend, to facilitate connection with the evaporator inlets 42. This bend may be more or less as required to mate in flow connection with other evaporator inlet 42 configurations.

Figure 6:
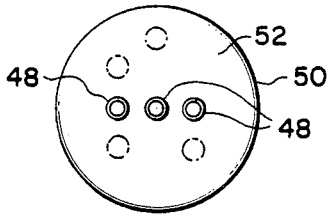
FIG. 6 shows an end surface view of the tube end cap.

The tube end cap 50 as in the preferred embodiment is shown in more detail in FIG. 6 in a view of the end surface 52. A number of various optional positions at which additional apertures 48 may be defined are shown as circles in dotted outline. The actual number of apertures 48 which must be defined in the end surface 52 will vary as discussed above. It will be appreciated that these locations are exemplary and not limiting, as such additional apertures may be readily formed during manufacture of the capillary tube assembly 30.

Preferably, the capillary tube assembly 30 is manufactured by a method which involves the following steps: (1) the number of evaporator inlets 42 and hence capillary tubes 32 is determined; (2) the requisite number of capillary tubes 32 are identically preformed, each with a bend adjacent the capillary tube outlet 82; (3) a like number of apertures 48 are defined in the end surface 52 of a tube end cap 50, preferably by die-press, drilling, or similar machining operations; (4) the capillary tubes 32 are inserted through the apertures 48 in the end surface 52 so that the capillary tube outlets 82 are spaced apart from the tube end cap 50 and from each other by a distance $S_1$, $S_2$ and so on for $S_{n-1}$, where n is the number of capillary tubes 32, leaving an exterior portion 90 and an interior portion 92 of each capillary tube 32; (5) positionally securing the capillary tubes 32 in the apertures 48 of the tube end cap 50 as discussed above; (6) inserting the interior portions 92 of the capillary tubes 32 into the interior 62 of the tube assembly body 60 so that the capillary tube inlets 80 are disposed therein to receive refrigerant therefrom; and (7) securing the tube end cap 50 to the outlet portion 70 of the tube assembly body 60 as discussed above.

To complete the manufacture of a suitable refrigeration system 10, it is additionally necessary to provide a compressor 12 having a suction port 14 in flow connection with the evaporator 40 and a discharge port 16 in flow connection with a condenser. which is in turn placed in flow connection with the assembly body 60 at the inlet aperture 66 of the inlet portion 64.

As desired, additional steps could be performed to adapt the capillary tube assembly 30 to various embodiments of refrigerations systems 10. For example, the capillary tube assembly 30 shown in FIG. 1 requires the additional step of forming a 90 degree bend in the capillary tubes 30 at a distance D from the tube end cap 50, and preferably a second 90 degree bend at a second selected distance from the first bend. Optionally, one or more bends may be performed upon the completed capillary tube assembly 32 in the assembly body 60, as discussed above, where necessary to improve the routing or compactness of the capillary tube assembly 30 in the refrigeration system 10. Also, the diameter of the inlet portion 63 may be reduced by turning or by die press operations prior to the insertion of the capillary tubes 32 to accommodate the diameter of the particular piping 24 connecting the condenser and the capillary tube assembly 30. Finally, where it is expected that the refrigeration system 10 will generate undesirable noise or vibration, the additional step of forming a waveform bend on the interior portion 92 of the capillary tubes 32 may be performed prior to insertion of the capillary tubes 32 into the interior 62 of the assembly body 60.

Those skilled in the art will appreciate that a number of capillary tubes 32, even of various selected diameters and lengths, can be preformed and ready for use, and could be employed in combinations of different diameter and length if desirable on any given refrigeration system with a suitably adapted tube end cap 50 having the necessary number and diameter of apertures 48. Furthermore, various sizes of assembly bodies 60 and tube end caps 50 may be prepared in advance of assembly as well to facilitate adaptation of the capillary tube assembly 30 to a variety of refrigeration systems 10.

FIG. 3 shows an alternative embodiment of FIG. 2 wherein the portion of the capillary tube 32 which is disposed in the interior 62 of the tube assembly body 60 is given a waveform prior to the fixing of the tube end cap 50 to the assembly body 60. This waveform shown is similar to a Sine waveform, although many variations would be equally suitable, and may assist in controlling vibrations and noise in the refrigeration system 10 in operation.

Figure 4:
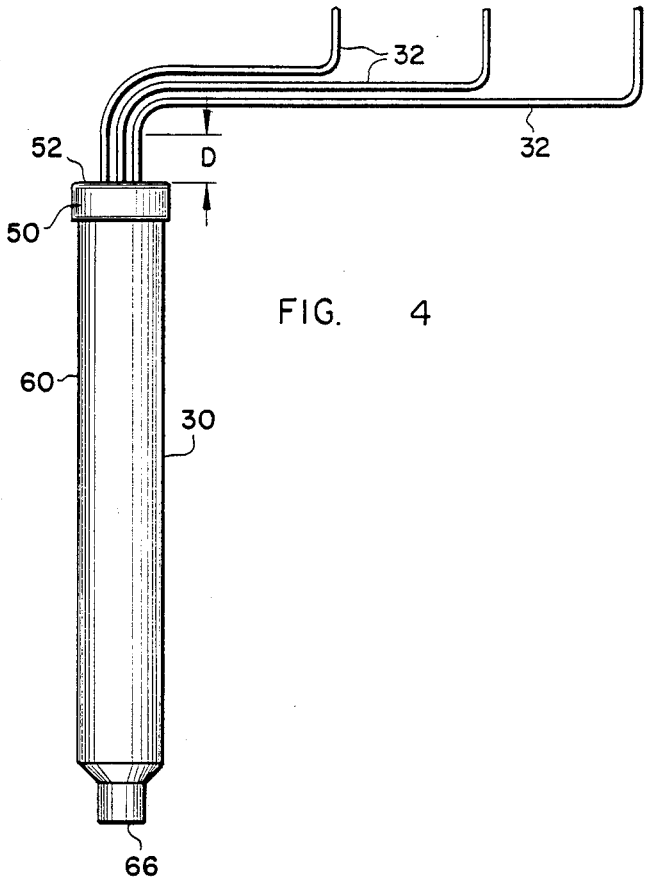
FIG. 4 shows yet another view of the subject invention having a bend formed in the capillary tubes thereof.

FIG. 4 shows yet another alternative embodiment of the capillary tube assembly 30 shown in FIG. 2. In this embodiment, the capillary tubes 32 have been bent 90 degrees about a point spaced from the end surface 52 a distance D. As shown in FIG. 1 as well, suitable bends may be applied simultaneously to all capillary tubes 32 at one or more locations as desired for any particular refrigeration system 10 to form the capillary tube assembly 30 into a compact and readily installed component.

Figure 5:
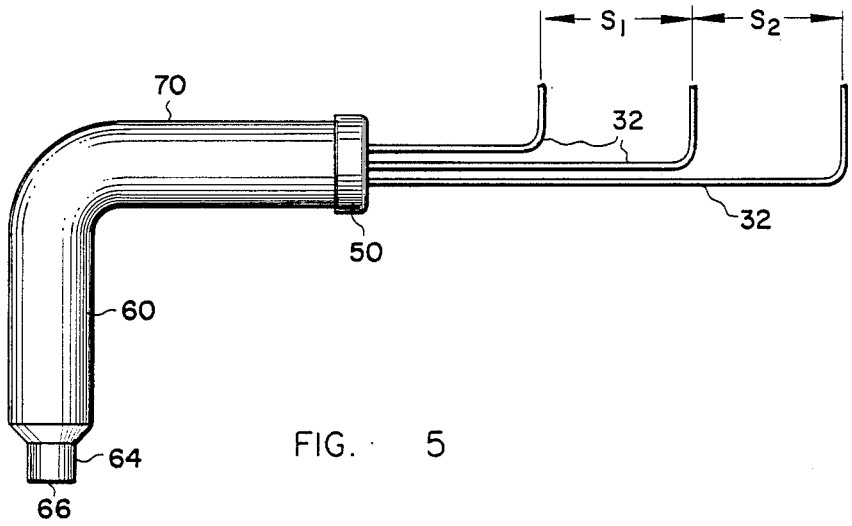
FIG. 5 shows the capillary tube assembly of FIG. 1 having a bend formed in the capillary tube body.

FIG. 5 shows yet another alternative embodiment of the capillary tube assembly 30 shown in FIG. 2 wherein a bend has been formed in the tube assembly body 60. Specifically, the outlet portion 70 has been formed into a 90 degree bend about a radius exterior to the tube assembly body 60. Since the inlet portion 64 could also be of extended length, it will be appreciated that the inlet portion 64 could also have a bend formed therein, and that the bends may be of greater or less than 90 degree bends.

The capillary tube assembly 30 of the subject invention is substantial improvement over the prior art. The apparatus is simple, eliminating unnecessary exposed capillary tubing and corresponding support hardware, and the expense and possibility of damage always attendant therewith. The method of manufacture is also straightforward, simple and inexpensive to implement, avoiding the necessity of providing assembly fixtures for a multitude of different refrigeration systems and reducing the number of parts which must be held in inventory during manufacture by providing a standardized apparatus and hence a standardized method of manufacture suitable for many different refrigeration systems.

Modifications to the preferred embodiment of the subject invention will be apparent to those skilled in the art within the scope of the claims that follow hereinbelow.

What is claimed is:

1. A refrigeration system comprised of:

a compressor having a suction port and a discharge port;

a condenser in flow connection with said discharge port;

a capillary tube assembly including a plurality of preformed substantially identical capillary tubes having capillary tube inlets and capillary tube outlets, a tube end cap defining a plurality of apertures for sealingly accepting said capillary tubes therethrough, and a tube assembly body defining an interior having a portion of said preformed capillary tubes therein, said tube assembly body having a first aperture defining an inlet and a second aperture defining an outlet having said tube end cap sealingly secured thereacross, said inlet in flow connection with said condenser., an evaporator having a plurality of spaced apart evaporator inlets and an evaporator outlet, each said evaporator inlet in flow connection with one of said capillary tube outlets, said evaporator outlet in flow connection with said compressor suction port.

2. The refrigeration system as set forth in claim 1 wherein said tube assembly body is cylindrical.

3. The refrigeration system as set forth in claim 2 wherein said tube assembly body is further comprised of a first body portion including said inlet, said first body portion having a first body portion diameter and a second body portion including said outlet, said second body portion having a second body portion diameter.

4. The refrigeration system as set forth in claim 3 wherein the first body portion diameter is less than the second body portion diameter.

5. The refrigeration system as set forth in claim 4 wherein the refrigeration system further includes a pipe for flow connection between said condenser and said tube assembly body, said pipe having a pipe diameter sized for interference fit with the first body portion diameter of said first body portion.

6. The refrigeration system as set forth in claim 1 wherein each said preformed capillary tube includes a preformed bend adjacent said capillary tube outlet.

7. The refrigeration system as set forth in claim 6 wherein said preformed capillary tubes are disposed in parallel.

8. The refrigeration system as set forth in claim 7 wherein said capillary tube assembly further includes capillary tubes having bent portions between said capillary tube outlets and said tube end cap, said bent portions spaced a uniform distance from said tube end cap.

9. The refrigeration system as set forth in claim 8 wherein the capillary tube inlet of each said capillary tube disposed in said interior of said tube assembly body is spaced apart from the capillary tube inlet of the other capillary tubes by a distance equal to that of said spaced apart evaporator inlets.

10. The refrigeration system as set forth in claim 3 wherein the portions of said preformed capillary tubes disposed within said tube assembly body further include waveform bend portions.

* * * * *

UNITED STATES PATENT AND TRADEMARK OFFICE

CERTIFICATE OF CORRECTION

PATENT NO. : 4,955,210

DATED : September 11, 1990

INVENTOR(S) : William G. Hansen

It is certified that error appears in the above-identified patent and that said Letters Patent is hereby corrected as shown below:

In The Claims:

Claim 10, Column 8, line 12, "3" should be --9--.

Signed and Sealed this

Thirty-first Day of December, 1991

*Attest:*

HARRY F. MANBECK, JR.

*Attesting Officer*

*Commissioner of Patents and Trademarks*